United States Patent [19]

Jackson

[11] Patent Number: 4,532,909

[45] Date of Patent: Aug. 6, 1985

[54] BUTTERFLY CARBURETION SYSTEM

[76] Inventor: Maurus E. Jackson, 1207 S. Flower St., Burbank, Calif. 91505

[21] Appl. No.: 593,497

[22] Filed: Mar. 26, 1984

Related U.S. Application Data

[63] Continuation of Ser. No. 388,012, Jun. 14, 1982, abandoned, which is a continuation of Ser. No. 151,731, May 20, 1980, abandoned.

[51] Int. Cl.[3] ..... F02M 29/00

[52] U.S. Cl. ..... 123/590; 48/189

[58] Field of Search ..... 123/590, 593, 591; 48/189.4

[56] References Cited

U.S. PATENT DOCUMENTS

| | | | |
|---|---|---|---|
| 3,077,391 | 2/1963 | Guffra | 123/590 |
| 3,414,242 | 12/1968 | Booteleux | 123/590 |
| 3,827,416 | 8/1974 | Ader et al. | 123/590 |
| 3,847,125 | 11/1974 | Malherbe | 123/590 |
| 4,019,483 | 4/1977 | Konomi et al. | 123/590 |
| 4,031,876 | 6/1977 | Hoots | 123/593 |
| 4,088,104 | 5/1978 | Ibbott | 123/590 |
| 4,130,099 | 12/1978 | Ferguson | 123/590 |
| 4,187,819 | 2/1980 | Longobardi | 123/590 |

FOREIGN PATENT DOCUMENTS

| | | | |
|---|---|---|---|
| 350122 | 6/1931 | United Kingdom | 123/590 |
| 566469 | 1/1945 | United Kingdom | 123/590 |

*Primary Examiner*—Ira S. Lazarus

*Attorney, Agent, or Firm*—Sellers and Brace

[57] ABSTRACT

A butterfly regulated carburetion system having its outlet connected to the intake manifold by a device restricting fuel and air flow very substantially from the rated flow capacity of an OEM carburetor in a manner promoting improved vaporization of the fuel and thorough mixture thereof with air before exit into the inlet of an OEM inlet manifold thereby to obtain more uniform proportions of fuel and air to each cylinder. These objectives are achieved by provision of a riser plate having a converging fuel vaporizing and mixing passage at least as long as the diameter of the OEM carburetor outlet. When the OEM engine is applied to a typical conventional vehicle, the device provides improved acceleration, better idling, greater power and utilizes substantially less fuel while retaining optimum drivability factor of 92 miles per hour.

18 Claims, 8 Drawing Figures

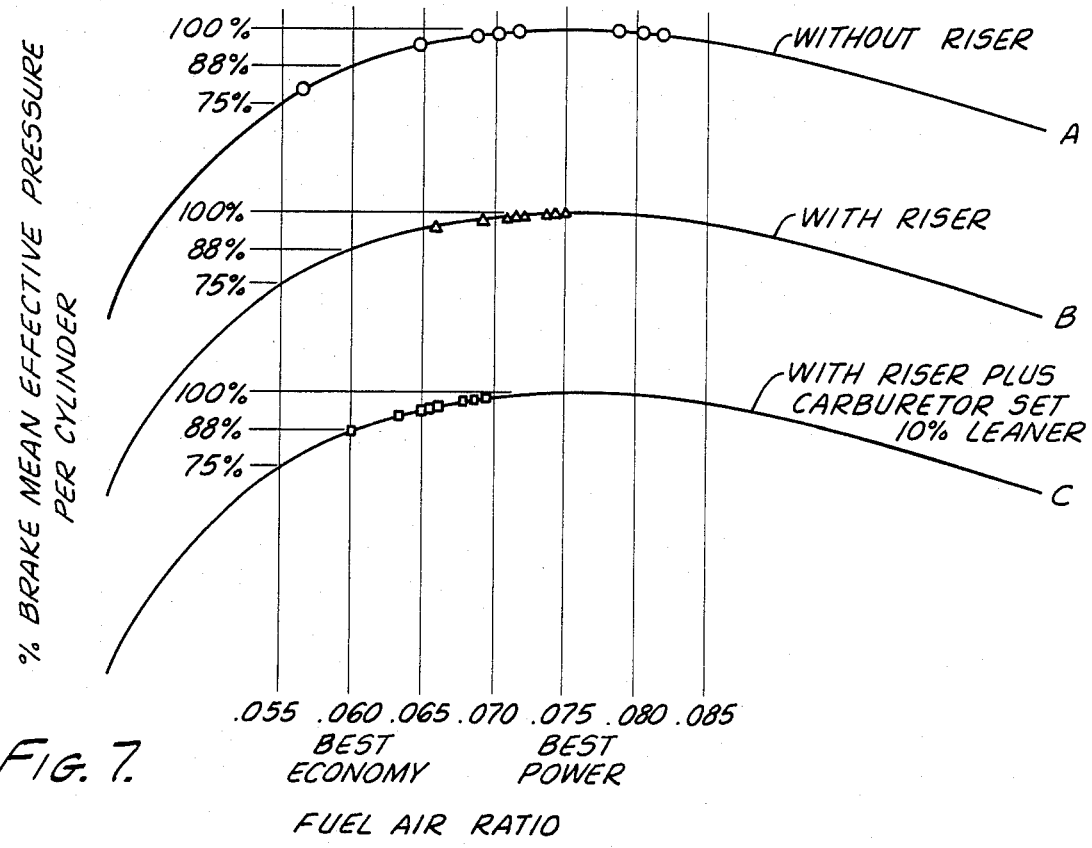
FIG. 7.
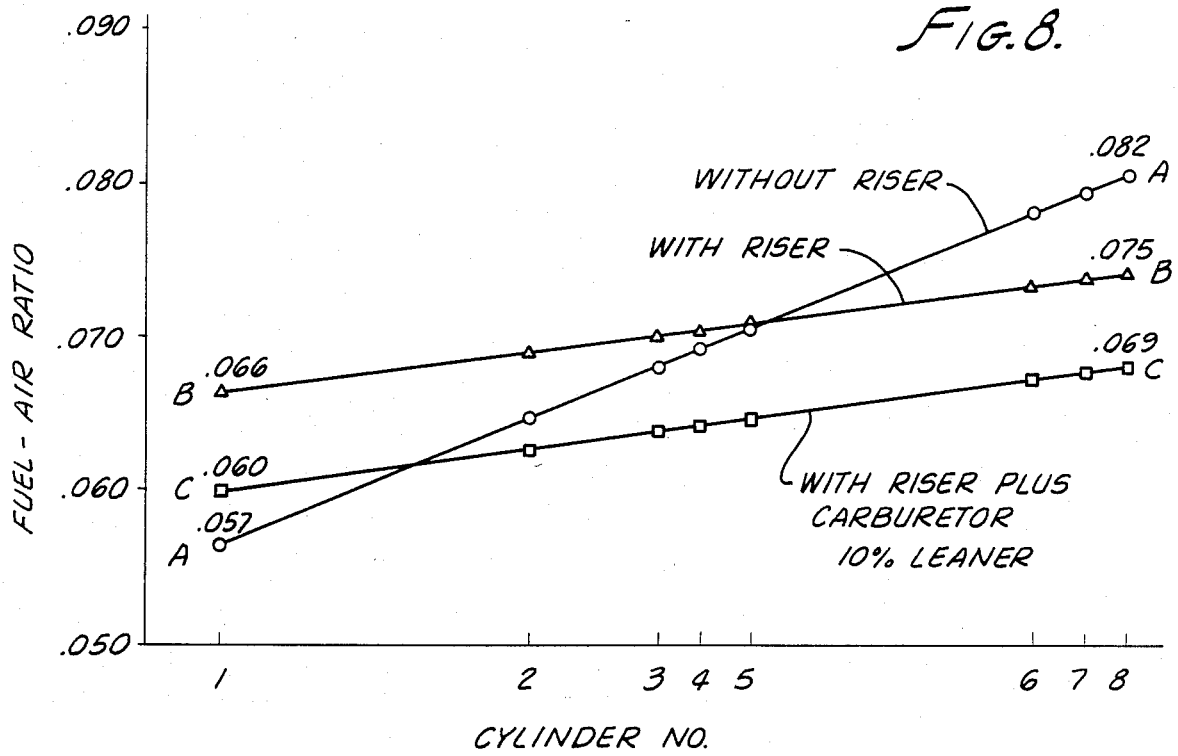

BUTTERFLY CARBURETION SYSTEM

This application is a continuation of my application for U.S. Letters Patent, Ser. No. 388,012 filed June 14, 1982, now abandoned, which was a continuation of my application Ser. No. 151,731, filed May 20, 1980, now abandoned, entitled Butterfly Carburetion System.

This invention relates to carburetion systems and more particularly to an improved butterfly regulated carburetion system providing greater power and superior performance characteristics utilizing substantially less fuel.

BACKGROUND OF THE INVENTION

It has been well known among automotive engineers that performance characteristics of vehicles with carburetor-equipped fuel systems have markedly inferior performance and fuel consumption characteristics than engines equipped with fuel injection systems. This is due to the fact that the fuel and air charge to each cylinder can be accurately metered and controlled with a fuel injection system whereas the fuel air ratio of the mixture delivered to the cylinders of an eight cylinder carburetor-controlled engine typically ranges between 0.057 for the leanest cylinder to 0.090 for the richest cylinder. The fuel air ratio supplied to the remaining cylinders varies widely from one another but lie between these two extremes.

Until recently fuel costs have been so low that the related inefficiencies and losses in performance were generally acceptable by the public. However, other users were not as complaisant and numerous efforts have been made by innovators and designers to achieve more complete fuel and air mixture both at the carburetor and particularly in the area between the carburetor outlet and the engine cylinders. Typical patents disclosing these prior proposals include Lohn U.S. Pat. No. Re. 27,378; McKeever U.S. Pat. No. 1,581,461; Welling U.S. Pat. No. 1,866,829; Herbst U.S. Pat. No. 2,793,152; Gaffra U.S. Pat. No. 3,077,391; Herbst U.S. Pat. No. 3,114,669; Hanff U.S. Pat. No. 4,105,574; Hoots U.S. Pat. No. 4,024,849; Hoots U.S. Pat. No. 4,031,876; Gaylord 4,086,899; Ikegaya U.S. Pat. No. 4,153,029; Longobardi U.S. Pat. No. 4,187,819; Bouteleux U.S. Pat. No. 3,414,242; Ader U.S. Pat. No. 3,827,416; Konomi U.S. Pat. No. 4,019,483; and Ibbott U.S. Pat. No. 4,088,104.

Lohn merely proposes an adaptor plate for coupling a carburetor to the intake manifold and features flaring fuel mixture passages solely to facilitate mounting either a small or a large carburetor on an engine having a large manifold and likewise permitting either type carburetor to be mounted on an engine having a small intake manifold. McKeever proposes to promote better mixing of the fuel and air en route to the manifold by inducting a curtain of air crosswise of the fuel and air mixture en route to the manifold. Welling provides a frusto-spherical passageway at the carburetor outlet having a diametric partition with forwardly converging sidwalls cooperating with one another to set up two oppositely directed eddy currents within the entrance to the inlet manifold. The partition is located between the two eddy currents and acts as a barrier to fuel flow into one set of eddy currents thereby nullifying his objective, Guffra proposes three plates secured across the carburetor outlet and two of which have spirally disposed blades in the path of the fuel mixture causing it to swirl to aid mixing and vaporization of the fuel and one of which has by-pass aperatures for recirculating some of the mixture. The two Herbst patents merely propose a laminated sealing gasket and a method of making the same for insertion between a carburetor and an intake manifold to prevent excessive heat transfer from the engine to the carburetor. Bouteleux discloses a fuel homogenizer having valve controlled passages for inducing auxiliary or secondary air into the fuel and air mixture discharging from the carburetor and said to aid engine idling, reduce fuel consumption while regularizing cylinder temperatures, and to improve combustion. Hanff provides an enlarged chamber between his carburetor and the intake manifold enclosing a spoked diaphragm to stimulate turbulence in the fuel-air mixture and promote vaporization of the fuel. Hoots proposes the insertion of a three quarter inch plate between the carburetor and the manifold having a converging fuel and air passageway supporting a multiplicity of 15 to 25 layers of 400 mesh screen to aid fuel vaporization. Fuel not vaporized is withdrawn and returned to the carburetor. Such screening seriously interferes with air flow and deposits of fuel additives would quickly render the device inoperative. Ader proposes an accessory interconnecting both the intake and the exhaust manifolds to the carburetor outlet. This accessory circulates hot exhaust gases past thin walled sleeves conveying the fuel and air mixture to the intake manifold thereby to preheat the mixture and to vaporize the fuel. Specially designed manifolds are necessary for use with this accessory. Gaylord proposes a spacer for installation between the carburetor and manifold formed of a multiplicity of laminations alternate ones of which have larger openings for the fuel and air mixture than the remaining laminations and alleged to create turbulence to promote fuel and air mixing. Ikegaya seeks to achieve similar results by providing a spacer having a helical or inclined ledge in the air passage wall along which a film of fuel flows while evaporating. Longobardi proposes a spiral spring in the path of the fuel and air mixture to produce a spiralling vortex to enhance mixing and vaporization of fuel. Konomi proposes a variety of sleeves having various deflecting baffles at their outlet end for redirecting the fuel and air mixture downstream from the carburetor and within the intake manifold. Some embodiments are designed for use in the primary air stream and others in the secondary air stream. Ibbott discloses a tapered porous sleeve downstream from the carburetor intended to create a pressure differential across its wall claimed as useful in aiding vaporization of fuel and in reducing carbon monoxide in the exhaust gases.

The foregoing and other proposals for original equipment manufacture carburetor regulated fuel feeding systems (commonly designated OEM) have overlooked and disregarded major causes of unequal ratios of fuel and air fed to the engine cylinders, namely, the introduction of liquid fuel on one side of the butterfly valve, and closely spaced to one branch only of the intake manifold under conditions not adequately conducive to rapid vaporization of the fuel and in a manner providing grossly different fuel and air ratios. These fuel and air ratios differ from 0.057 for the leanest cylinder to 0.082 for the richest cylinder.

SUMMARY OF THE INVENTION

The many shortcomings and disadvantages of prior proposals for improving the vaporization and equitable distribution of a combustible mixture provided by butterfly type carburetion are avoided by this invention. These objectives are achieved by inserting a simply constructed device between the OEM carburetion outlet and the OEM engine intake manifold having numerous functions. Vertical space limitations in a vehicle engine compartment impose severe restrictions on the space available between the carburetor outlet and the horizontal runners of the engine intake manifold. However, adequate space is customarily available for the introduction of a riser duct device between the carburetor and the intake manifold inlet having a specially designed fuel vaporizing and air mixing passage or chamber having a length preferably not less than the outlet diameter of the carburetor. This passage converges towards its outlet to restrict the quantity of air flow substantially over the rated flow capacity of the carburetor venturi thereby substantially increasing the velocity of flow and lowering the pressure. The reduced pressure and the smaller area of the flow passage promotes rapid evaporation and thorough dispersion of the vapor into the smaller diameter stream flowing through the outlet of this converging passage. These end results are aided by the provision of a limited number of barriers in the flow path causing eddying and turbulence and conducting heat into the core of the stream.

Bench tests confirmed by road tests have shown that the air volume passing through a conventional OEM vehicle carburetor can be decreased up to nearly 50% without lowering the vehicle speed capability below 79 mph, thereby providing adequate emergency power requirements for vehicles operating at a statutory highway speed limit of 55 mph. The substantially smaller fuel and air mixing passage serving to satisfy these requirements is found to provide not only high efficiency fuel vaporization but highly uniform distribution of this vapor throughout the combustible mixture delivered to each of the cylinders.

The foregoing improvements in fuel vaporization and uniform distribution into air entering the manifold intake permits re-calibration of the carburetor by the substitution of smaller fuel jets to provide a leaner mixture and adjustment of the distributor to advance ignition timing. Engine operation is much smoother, acceleration and power output are both improved, and 8% to 12% fuel economy is achieved while retaining a drivability factor of 79 mph operating within a 55 mph legal speed limit.

Accordingly, it is a primary object of this invention to provide a unique method of forming a combustible fuel mixture and an improved butterfly-regulated fuel system for an internal combustion engine.

Another object of the invention is the provision of an improved method and apparatus for equalizing the combustible mixture delivered to each cylinder of an engine equipped with an OEM butterfly-regulated carburetion system.

Another object of the invention is the provision of a simple device for retrofit insertion between an OEM carburetor outlet and an OEM engine intake manifold having a low pressure fuel vaporization and air mixing passage operating at sub-atmospheric pressure thereby to enhance high velocity air flow, rapid vaporization of fuel, and thorough dispersion thereof into the air before entry thereof into the manifold to provide a substantially uniform mixture of fuel and air for each cylinder.

Another object of the invention is to provide an improved butterfly regulated carburetion system for an engine propelled vehicle characterized by greater power output, better acceleration, more economical fuel consumption, and superior smoothness and operating characteristics.

These and other more specific objects will appear upon reading the following specification and claims and upon considering in connection therewith the attached drawing to which they relate.

Referring now to the drawing in which a preferred embodiment of the invention is illustrated:

FIG. 7 shows three curves wherein the fuel-air ratio is plotted against brake means effective pressure in each cylinder of an OEM eight cylinder engine, the top curve being without the invention riser, the middle curve being for an engine with the invention riser and the lower curve being for a riser-equipped OEM engine and a leaner fuel mixture; and FIG. 8 is a diagrammatic view showing the variations in the fuel-air ratio supplied to each cylinder of the engine depicted in FIG. 7.

Figure 1:
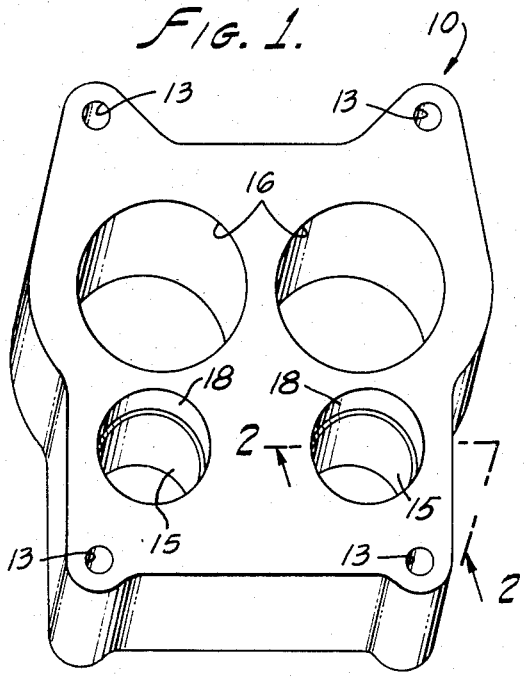
FIG. 1 is a perspective view of a riser plate embodying the features of this invention.
Figure 2:
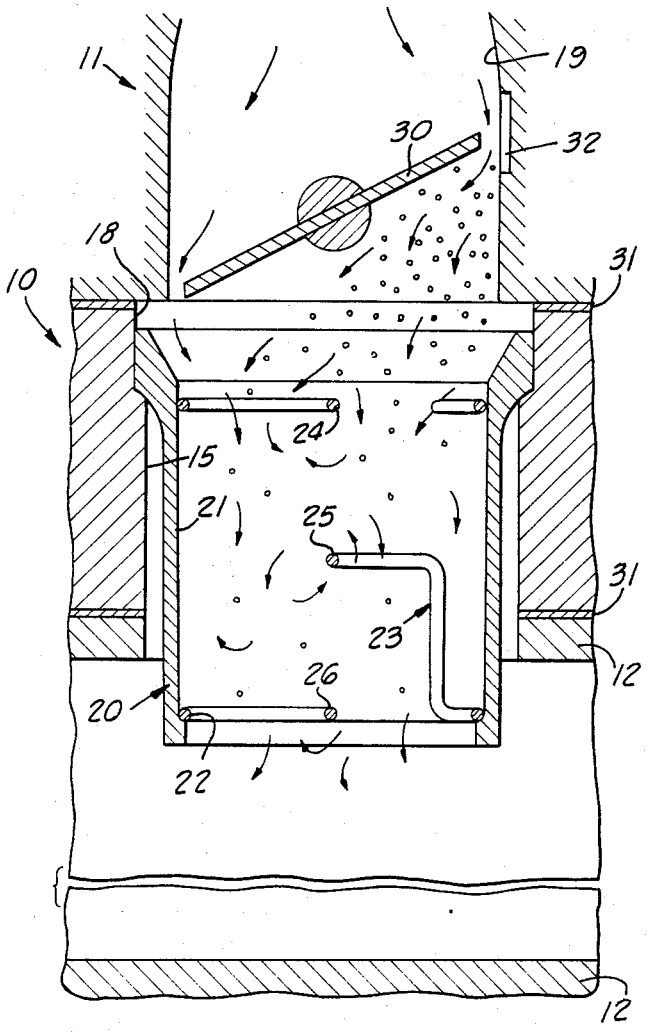
FIG. 2 is a vertical cross-sectional view on an enlarged scale taken along line 2—2 on FIG. 1 after installation of the riser plate between the outlet of an OEM carburetor and an OEM engine inlet manifold.
Figure 3:
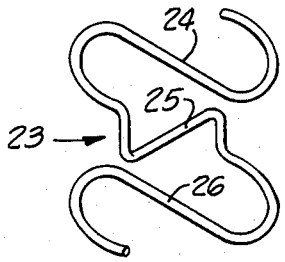
FIG. 3 is a perspective view on a reduced scale of a turbulence inducing deviced for installation in the fuel and air mixing passageway of the riser plate.
Figure 4:
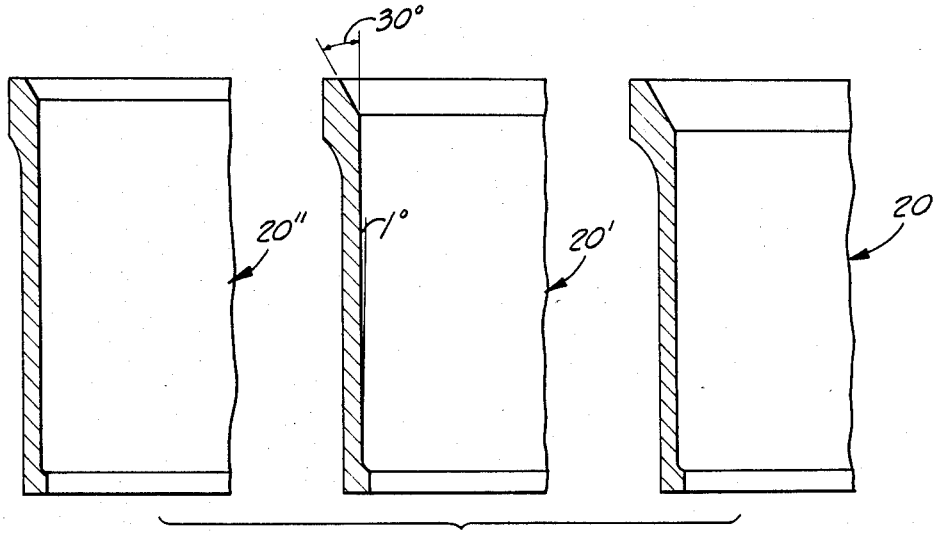
FIG. 4 is a fragmentary cross-sectional view of three different sizes of fuel and air mixing sleeves selectively installable in the riser plate.

Referring initially to FIGS. 1–4, there is represented a riser plate 10, preferably of a suitable non-heat conductive material such as phenolic or the like, having a perimeter suitably shaped for assembly between the primary and secondary air outlets of OEM carburetor 11 and the inlet of an OEM engine intake manifold 12. To this end, riser 10 is provided with bores 13 for each of the carburetor assembly bolts, not shown. As here illustrated by way of example, riser 10 has a pair of primary air and fuel passageways 15, and a pair of secondary fuel and air passageways 16. As is best shown in FIG. 2, each primary passage 15 has a shouldered inlet 18 of larger diameter than the outlet end of the carburetor primary venturi passage 19. The shouldered inlet 18 supports the outwardly flaring upper end of a fuel and air mixing sleeve 20. All except the shouldered inlet end of sleeve 20 is spaced inwardly from the wall of passage 15. The inner wall of sleeve 20 is formed essentially of first and second converging tapered portions which merge smoothly somewhat downstream from the upper or inlet of the sleeve. The surface or portion 21 converges downwardly at a slight or acute angle, such as 1 or 2 degrees to the sleeve axis whereas the relatively axially short surface of the second or upstream portion converges downwardly at a relatively obtuse angle many times greater, such as 30 degrees as shown in FIG. 4. The lower end is preferably provided with a shoulder 22 seating a serpentine insert 23 effective to produce turbulence and disintegration of particles of liquid fuel and to enhance dispersion of the fuel into the air. Some users prefer to omit insert 23.

As shown in FIG. 3, insert 23 is formed from a single length of wire with portions thereof engaging the sidewall of the sleeve and other portions 24, 25 and 26 extending crosswise of the fuel and air stream. The entrance end of sleeve 20 diverges outwardly at a relatively steep angle, such as 30 degrees, with its larger end slightly larger than the outlet of venturi passage 19 and its smaller end merging with the upper end of the acutely downwardly converging surface 21 merging with a radially shallow shoulder 22. This shoulder provides an assembly seat for the mixing insert 23. It will be understood that this insert may be formed in various ways or that one or more pins may be supported transversely of sleeve 20 with their ends seated in radial bores.

As shown in FIG. 2, by way of example, the primary carburetor venturi 19 has an outlet diameter of 1⅜ths inches, the larger end of the tapered surface 28 of sleeve 20 has a diameter of 1½ inches, the outlet diameter of sleeve 20 is 1.260 inches, sleeve 20 has a length of 1.625 inches, and the riser plate 10 has a thickness of 1.250 inches. The carburetor venturi passage 19 is equipped with a typical butterfly valve 30 shown slightly open with its higher edge opposite the usual fuel inlet port 32 in communication with a readily demountable calibrated fuel jet, not shown, but present in all butterfly regulated carburetors.

FIG. 4 shows the fuel vaporizing and mixing sleeve 20 along with two slightly larger sleeves 20' and 20''. All three sleeves have a flanged inlet end the outer periphery of which is sized for a sliding fit in the shouldered inlet end 18 of bore 15 through riser plate 10. Sleeve 20' is dimensioned for a vehicle engine having a drivability factor of 84 mph and sleeve 20'' is dimensioned for a vehicle engine having a drivability factor of 92 mph. In this connection see FIG. 5.

It will be understood that the vehicle operator will select a fuel and air mixing sleeve for use in riser plate 10 providing the fuel economy and drivability factor characteristics desired by that operator. Only three sleeve sizes are shown in FIG. 4 but a different size sleeve is required to achieve the results depicted by all except the lowermost curve shown in FIG. 5 as will become apparent from the description of those curves set forth below.

OPERATION AND PERFORMANCE CHARACTERISTICS

The installation of the riser plate 10 is accomplished simply by detaching OEM carburetor 11 and inserting the riser between the several carburetor outlets and the corresponding inlets of the OEM intake manifold 12. A gasket 31 is placed against the upper and lower faces of the riser and longer assembly bolts, not shown, are utilized to secure the carburetor and riser assembly to the manifold. Additionally the carburetor is recalibrated to reduce fuel flow in the range of 10% to 12%. This is done by installing substitute jets. For example, an OEM Chevrolet V8 engine typically equipped with jets having a port of 0.078 inches providing an air-fuel ratio of the order of 13.9 to 14.1 to one are replaced with smaller jets providing a ratio of 16.6:1. Jets having an orifice of 0.074 inches would be appropriate. A test run can be made following which an exhaust analyser is employed to confirm that the right size jet has been installed. If not, the jets should be replaced by ones of slightly larger or smaller size until the desired fuel-air ratio has been obtained.

A Chevrolet engine also normally operates with a 28 degree to 32 degree advance setting of the distributor. However, with the riser plate installed, superior performance is achieved by using an advance setting of about 38 degrees.

The carburetor having been recalibrated and the ignition retimed, the vehicle is in readiness for operation with maximum efficiency and superior performance characteristics. All fuel enters through port 32 adjacent the higher edge of butterfly 30 at speeds below 50 to 60 mph. FIG. 2 shows the air entering past both the upper and lower edges of the butterfly. The air entering the upper edge of the butterfly tends to pick up and disintegrate the fuel into small droplets. The low pressure prevailing in the runners of manifold 12 in cooperation with the reduced flow area of the downwardly converging sleeve 20 quickly further reduces the pressure between the butterfly and the exit end of sleeve 20. This lower pressure condition within the sleeve substantially increases the flow velocity and the evaporation of the fuel. This evaporation is also promoted by the subdivision of the fuel particles by impact with insert 23 and the pronounced turbulence produced by this insert. The small cross-sectional area of the smooth-surfaced nonperforated passage provided by sleeve 20, the smaller cross-sectional area across which the fuel is dispersed, the substantially lower pressure and the very substantially reduced volume of air all cooperate and contribute to maximise evaporation of the fuel and the thorough and uniform mixing thereof with the air before it issues from the lower end of the sleeve 20 at a substantially higher velocity than the flow velocity from a stock engine carburetor without riser device 10. Typically, the combustible mixture exits from sleeve 20 at a velocity of about 81 feet per second at a vehicle speed of 55 mph on level ground.

Referring now to FIGS. 5 through 8, there is shown graphical presentations comparing performance characteristics of an OEM internal combustion engine powered vehicle having a conventional butterfly regulated carburetion system and the same engine retrofitted to incorporate the invention riser plate 10. The test data depicted in FIG. 5 was obtained from a 1978 Chevrolet truck having a vehicle gross weight of 5,400 lbs powered by an 8 cylinder engine of 454 cubic inch displacement. There plotted is the mileage per gallon, fuel consumption versus miles per hour of the factory engine, and the miles per hour capabilities of this engine when using different sizes of riser plates of this invention. The lowermost curve shows the factory carburetor with its rated 100% carburetion air flow. Overlying this curve are 5 other curves showing the carburetor modified to incorporate this invention using successive lower air flow rates ranging from a high of 78% of factory rated air flow to a low of 23%. The installation of riser plates restricting the fuel and air flow in progressively lower amounts improves accelleration but at a sacrifice in the attainable maximum speed. Thus it will be noted that the maximum speed capability decreases from 92 mph to 61 mph as the air supply decreases from 78% to 23% of the original 100% rating obtainable with the factory fuel system.

At the present time the national vehicle speed limit is 55 mph. Vehicle handling and safety requirements dictate that the vehicle be capable of exceeding this limit to meet emergency needs. The excess margin required to meet this need is known as the drivability factor and is defined as the maximum legal speed limit divided by log 2. The legal limit of 55 mph divided by log 2 gives 79 mph as the minimum safe vahicle speed capability. A safer speed capability of 92 mph is obtainable if one chooses a riser plate having a primary air passage restricting the primary air flow to about 78% of the factory rated capacity of the carburetor supplied by the engine manufacturer.

Figure 5:
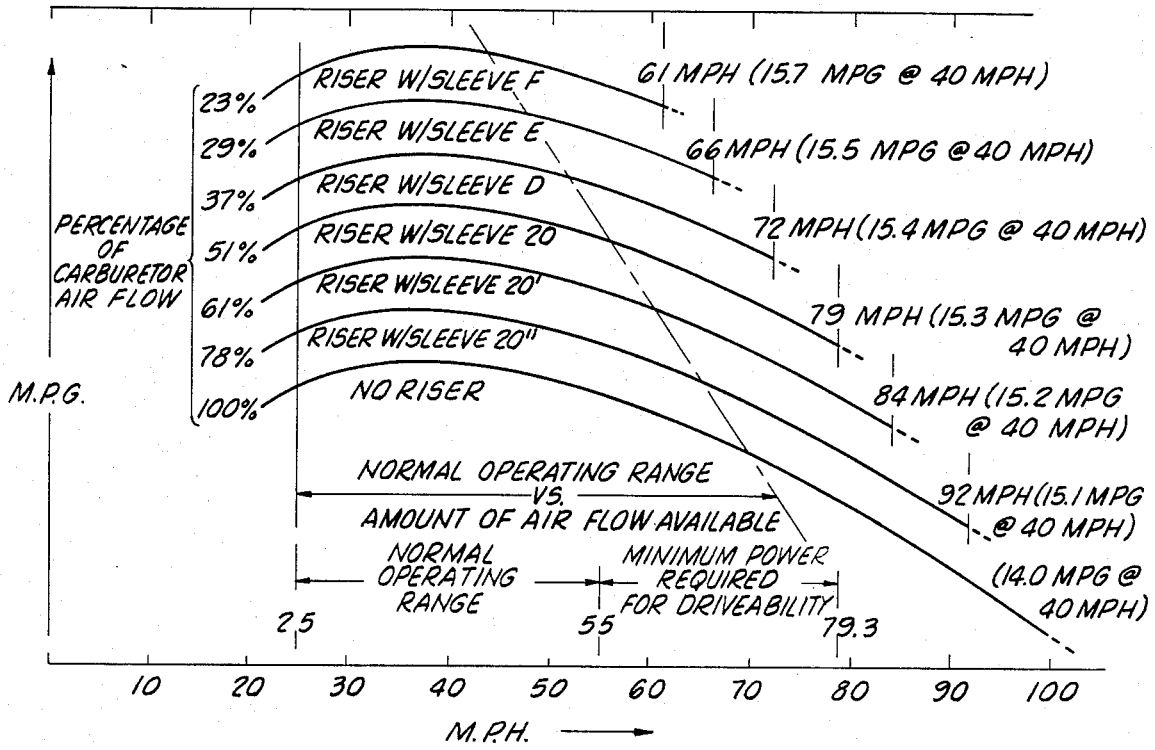
FIG. 5 is a diagrammatic showing of a series of riser plates having different size fuel and air mixing sleeves and indicating the effect thereof on maximum speed and fuel consumption of a vehicle operating on a level roadway.

FIG. 5 discloses that the vehicle there tested develops a maximum speed capability of 79 mph when equipped with a carburetion system operating with approximately 51% of the rated air flow of the factory carburetor. If the riser plate sleeve diameter decreases sufficiently to decrease the air flow to 37% of the carburetor rated flow, the vehicle drivability factor is lowered to 72 mph. Although this is substantially above the legal 55 mph speed limit, it leaves a precariously low available power margin to meet emergency speed needs. A safer speed margin is attained by using a riser plate wherein the primary air passage or passages reduce the air flow to 78% of the flow otherwise occurring without the riser plate. Road tests have demonstrated and confirmed that this reduced air flow not only assures a wide safety margin to meet emergency speed requirements but also maximum fuel economy at 40 mph operating speeds commonly used except on freeways and cross country driving.

Figure 6:
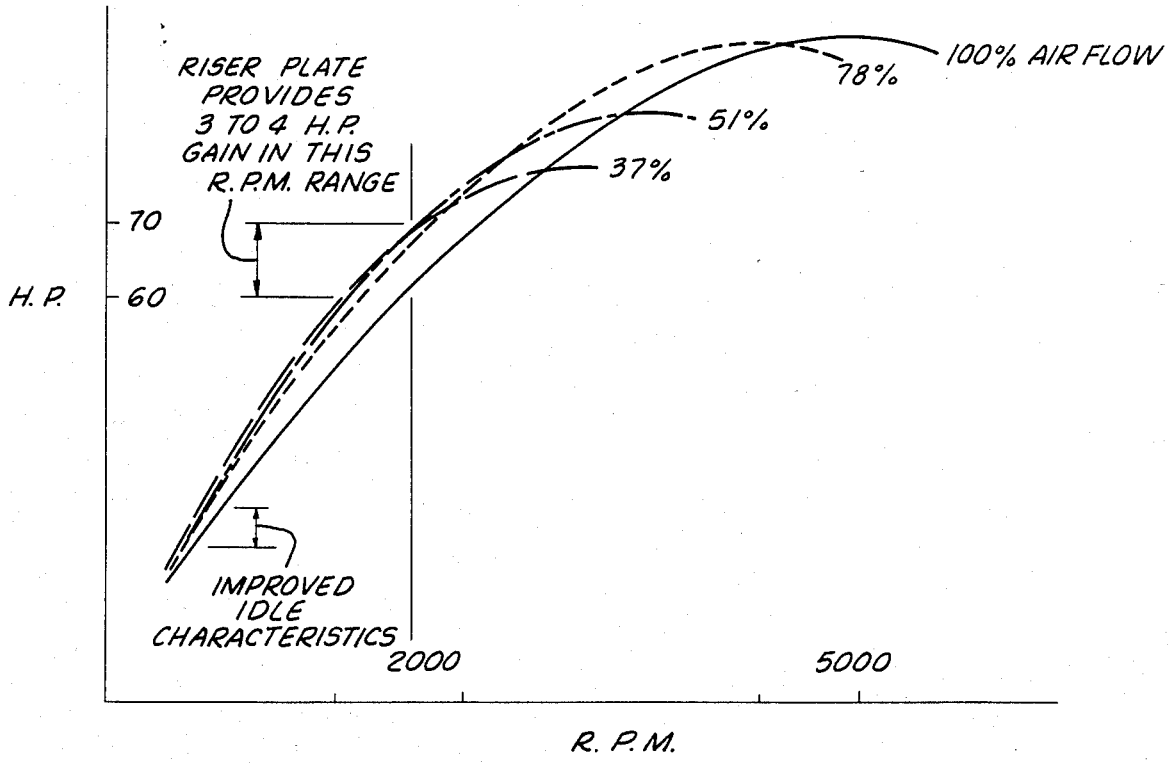
FIG. 6 shows a series of curves representing engine rpm versus horsepower output of an engine having conventional carburetion as compared with the same engine equipped with riser plates having different air flow capacities.

FIG. 6 depicts a series of curves contrasting the horse power developed over the operating speed range of an engine having a butterfly regulated fuel system when supplied with several percentages of the factory rated air flow. It will be observed that despite a pronounced power reduction at higher engine speeds resulting from reduced carburetion air, there is a gain in power output in the normal driving range as well as improved idling operation. At the normal vehicle driving speed, the power gain ranges between 3 and 4 horse power.

FIG. 7 depicts three curves showing the percent brake mean effective pressure for each of eight cylinders versus the fuel-air ratio delivered to each cylinder by a butterfly regulated carburetion system. The uppermost curve A represents conditions for an egine with a conventional OEM carburetor fuel system whereas curve B represents the condition for the same engine and carburetor retrofitted with the riser device of this invention but before recalibrating the fuel flow by substituting smaller fuel jets, whereas curve C shows the same carburetor equipped with a substitute fuel jet to supply 10% less fuel. The circles, triangles and squares distributed along the respective curves represent the actual fuel and air ratios of the combustible mixture supplied to each of the eight cylinders. The conventional carburetor/manifold without the riser plate 10 supplies a fuel and air mixture to the cylinders in ratios ranging between 0.057 for the leanest cylinder and 0.082 for the richest cylinder.

This undesirable non-uniform condition is greatly improved by the installation of riser plate 10 as is shown in curve B, it being noted that the leanest cylinder receives fuel and air in the ratio of 0.066 and in the ratio of 0.075 in the richest cylinder. Curve C shows that this narrow range variation in the fuel-air mixture is further improved when the carburetor is recalibrated 10% leaner. The rate of the fuel and air ratio varying in the very narrow range between 0.060 and 0.069. It will be noted that the fuel-air mixture for all cylinders is very close to that providing the greatest economy whereas the mixture received by the cylinders in curve B is that providing maximum power but at some sacrifice in fuel consumption.

The three curves depicted in FIG. 8 show the fuel-air ratio delivered to each cylinder of an eight cylinder engine, the curves A, B and C, corresponding to the carburetion system discussed above in FIG. 7.

RISER PLATE PORT SIZE CRITERIA

The criteria controlling the outlet port size of the primary air passage in the riser plate includes six factors, namely:

1. Engine displacement in cubic inches (D)
2. Engine volumetric efficiency (V) (typically 80%)
3. Maximum vehicle speed in mph (S)
4. Engine RPM at maximum vehicle speed (RPM)
5. Rated maximum carburetor air flow in CFM at $1\frac{1}{2}$ inches of mercury differential pressure (A)
6. Required air flow in CFM at maximum vehicle speed (A').

The functional relationship of these factors to determine the required volume of air flow for power needs at a specified maximum speed capability to meet emergency driving needs is expressed mathematically in the following equation:

$$A' = \frac{[D \times \text{RPM}]}{[2 \times 1728]} \times V$$

Assuming a vehicle engine has a displacement of 427 cubic inches and operates at 3,250 RPM to achieve a maximum vehicle speed of 79.3 mph, the primary air requirement is determined by the above equation to be $$A' = \frac{427 \times 3250}{2 \times 1728} \times 0.80 = 321.2 \text{ cfm}$$

If the maximum rated air flow of this engine's OEM carburetor, designated A'', is 625 cfm, the primary air passage through riser device 10 must be designed to provide a percentage reduction in air flow as follows:

$$\% \text{ Air flow reduction} = \frac{A'}{A''} \times 100$$

$$= \frac{321.2}{625} \times 100$$

$$= 51.3\%$$

While the particular improved butterfly carburetion system herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in the fuel supply system of a vehicle engine equipped with a butterfly regulated carburetor which comprises:

a riser plate device having upper and lower surfaces constructed for retrofit installation clamped between the fuel and air outlet of the engine's existing carburetor and the inlet of the engine's existing intake manifold for operation completely isolated from the engine's exhaust manifold;

said riser plate having a thickness approaching the diameter of said carburetor outlet and a non-perforated smooth-surfaced primary fuel and air mixing passage therethrough with the entrance thereof adjacent said upper surface of said riser plate;

said fuel and air mixing passage having smoothly merging first and second converging portions between the opposite ends thereof, said first portion being relatively short and obtusely tapering toward the adjacent end of said second portion, and said second portion being relatively long and slightly tapering toward the outlet end of said mixing passage and cooperating with said first portion to limit air flow therethrough of the order of 60% to 90% of the air flow which would occur through said carburetor without said riser plate device.

2. That improvement defined in claim 1 characterized in that the interior surface of said primary air and fuel mixing passage converges toward the outlet end thereof.

3. That improvement defined in claim 2 characterized in that the outlet end portion of said primary air-fuel mixing passage converges at a slight angle and including a portion near the inlet end thereof diverging toward a carburetor outlet at an angle many times greater than said slight angle of convergence.

4. That improvement defined in claim 3 characterized in that said fuel and air mixing passage is formed by a sleeve seated coaxially of a bore extending between and through said upper and lower surfaces of said riser plate and which bore is free of lateral passages opening through the sidewall thereof, and a major portion of the length of said sleeve being out of contact with and spaced from the wall of said bore.

5. That improvement defined in claim 1 characterized in that said riser plate device comprises a one piece plate, said fuel and air mixing passage being formed by a tapered tubular sleeve mounted in a bore through said riser plate and the major portion of which is located between the opposite ends of said bore having a length in excess of the thickness of said riser plate with the smaller end thereof projecting beyond the outlet end of said bore.

6. That improvement defined in claim 5 characterized in that a major portion of the length of said sleeve is out of contact with said bore through said riser plate.

7. That improvement defined in claim 1 characterized in that said riser plate device is formed of non-metallic poor heat conducting material.

8. That improvement defined in claim 1 characterized in that said riser plate device is provided with at least one primary air and fuel mixing passage and at least one secondary air and fuel mixing passage, and said primary air and fuel mixing passage having an outlet diameter less than and a length substantially greater than the inlet diameter thereof.

9. That improvement defined in claim 1 characterized in that said mixing chamber has a length axially thereof closely related to the diameter of said carburetor air passage.

10. That improvement in an OEM vehicle engine butterfly-regulated carburetion system which comprises:

a riser plate of non-metallic poor heat conductive material having generally parallel upper and lower surfaces spaced at least one inch apart insertable between the primary fuel and air outlet of the OEM butterfly-regulated carburetor and the outlet of the OEM engine intake manifold and out of communication with engine exhaust gases;

said riser plate having an imperforate fuel and air mixing passage the major portion of which is located between said upper and lower surfaces thereof and having imperforate sidewalls at least as long as the diameter of its inlet end and converging toward said intake manifold inlet, said imperforate sidewalls including first and second smoothly merging tapered surfaces the first of which is relatively short and obtusely tapered and the second of which is relatively long and acutely tapered and effective to limit air flow therefrom by an amount ranging between 5 and 30 per cent less than the air flow which would occur through said OEM carburetion system without said riser plate.

11. That improvement defined in claim 10 characterized in that the longer flow passage provided by said fuel and air mixing passage through said riser plate together with the flow-restricting characteristics thereof cooperate to provide substantially improved vaporization of the fuel and thorough intermixing thereof with air before issuing from the outlet end of said flow passage whereby all engine cylinders receive nearly equal proportions of fuel and air.

12. That improvement in a carburetion system of the type having an air passage therethrough controlled by a butterfly, that improvement which comprises:

means providing a fuel and air mixing chamber closely downstream from said butterfly and having aligned inlet and outlet openings in communication respectively with said butterfly-controlled passage and with an engine intake manifold;

the inner side of said mixing chamber having a first relatively short, relatively obtusely tapering surface at said inlet end which first surface merges smoothly at its smaller end with the larger end of a second relatively long, relatively acutely tapering conical surface in communication with said chamber outlet; and said first and second conical surfaces of said mixing chamber being sized to limit the air flow therefrom by an amount ranging between 60 and 95% of the air flow which would occur through said carburetor in the absence of said mixing chamber.

13. That improvement defined in claim 12 characterized in that said means providing said mixing chamber includes a mounting plate insertable and clampable between said carburetion air passage and the inlet of an engine intake manifold.

14. That improvement defined in claim 12 characterized in that said mounting plate is formed of low heat conductive material and having the major portion of said mixing located between the opposite faces of said mounting plate.

15. That improvement defined in claim 14 characterized in that said mounting plate has a through bore separably supporting a tubular sleeve formed interiorly thereof with said merging first and second tapered surfaces.

16. That improvement defined in claim 15 characterized in that said larger diameter inlet end of said tubular sleeve is closely adjacent the face of said mounting plate clampable to said carburetor outlet.

17. That improvement defined in claim 12 characterized in that said mixing chamber extends at least partially into said intake manifold when assembled thereto.

18. That improvement defined in claim 12 characterized in that said first surface lies at an angle to the axis of said chamber many times greater than the taper angle of said second surface.

* * * * *

UNITED STATES PATENT AND TRADEMARK OFFICE

CERTIFICATE OF CORRECTION

PATENT NO. : 4,532,909

DATED : 8/6/85

INVENTOR(S) : MAURUS E. JACKSON

It is certified that error appears in the above-identified patent and that said Letters Patent is hereby corrected as shown below:

Col. 10, Claim 10, line 8, change "outlet" to --inlet--.

Signed and Sealed this

*Thirteenth* Day of *May 1986*

[SEAL]

*Attest:*

*Attesting Officer*

DONALD J. QUIGG

*Commissioner of Patents and Trademarks*